US005509998A

United States Patent [19]

Strid et al.

[11] Patent Number: 5,509,998

[45] Date of Patent: Apr. 23, 1996

[54] METHOD AND APPARATUS FOR CLARIFYING GREEN LIQUOR

[75] Inventors: Kent Strid, Järbo; Rolf Oswaldson, Gävle, both of Sweden

[73] Assignee: Götaverken Energy Aktiebolag, Gothenburg, Sweden

[21] Appl. No.: 64,154

[22] PCT Filed: Nov. 20, 1991

[86] PCT No.: PCT/SE91/00786

§ 371 Date: Oct. 28, 1993

§ 102(e) Date: Oct. 28, 1993

[87] PCT Pub. No.: WO92/09742

PCT Pub. Date: Jun. 11, 1992

[30] Foreign Application Priority Data

Nov. 21, 1990 [SE] Sweden ..... 9003697

[51] Int. Cl.[6] ..... D21C 11/00

[52] U.S. Cl. ..... 162/29; 162/30.1; 162/30.11; 423/DIG. 3

[58] Field of Search ..... 162/29, 30.1, 30.11, 162/41; 423/DIG. 3

[56] References Cited

U.S. PATENT DOCUMENTS 4,941,945 7/1990 Pettersson ..... 162/29

FOREIGN PATENT DOCUMENTS 95670 5/1939 Sweden .
8700549 9/1988 Sweden .

*Primary Examiner*—David L. Lacey
*Assistant Examiner*—Dean T. Nguyen
*Attorney, Agent, or Firm*—Bacon & Thomas

[57] ABSTRACT

In a chemicals recovery plant in a sulphate pulp mill, in order to provide green liquor with improved sedimentation and filtration properties, there is passed, from a flow (10) of slaked lime and green liquor between a lime slaker (9) and a causticizing tank (1 1), a partial flow (32, 35) to a soda dissolver (2) or to a container (26) for unclarified green liquor provided after the soda dissolver. For this purpose there is provided, in a line (10) between the lime slaker (9) and the causticizing tank (11), a branch line (32, 35) which passes to the soda dissolver (2) or to a container (26) for unclarified green liquor provided after the soda dissolver.

7 Claims, 1 Drawing Sheet

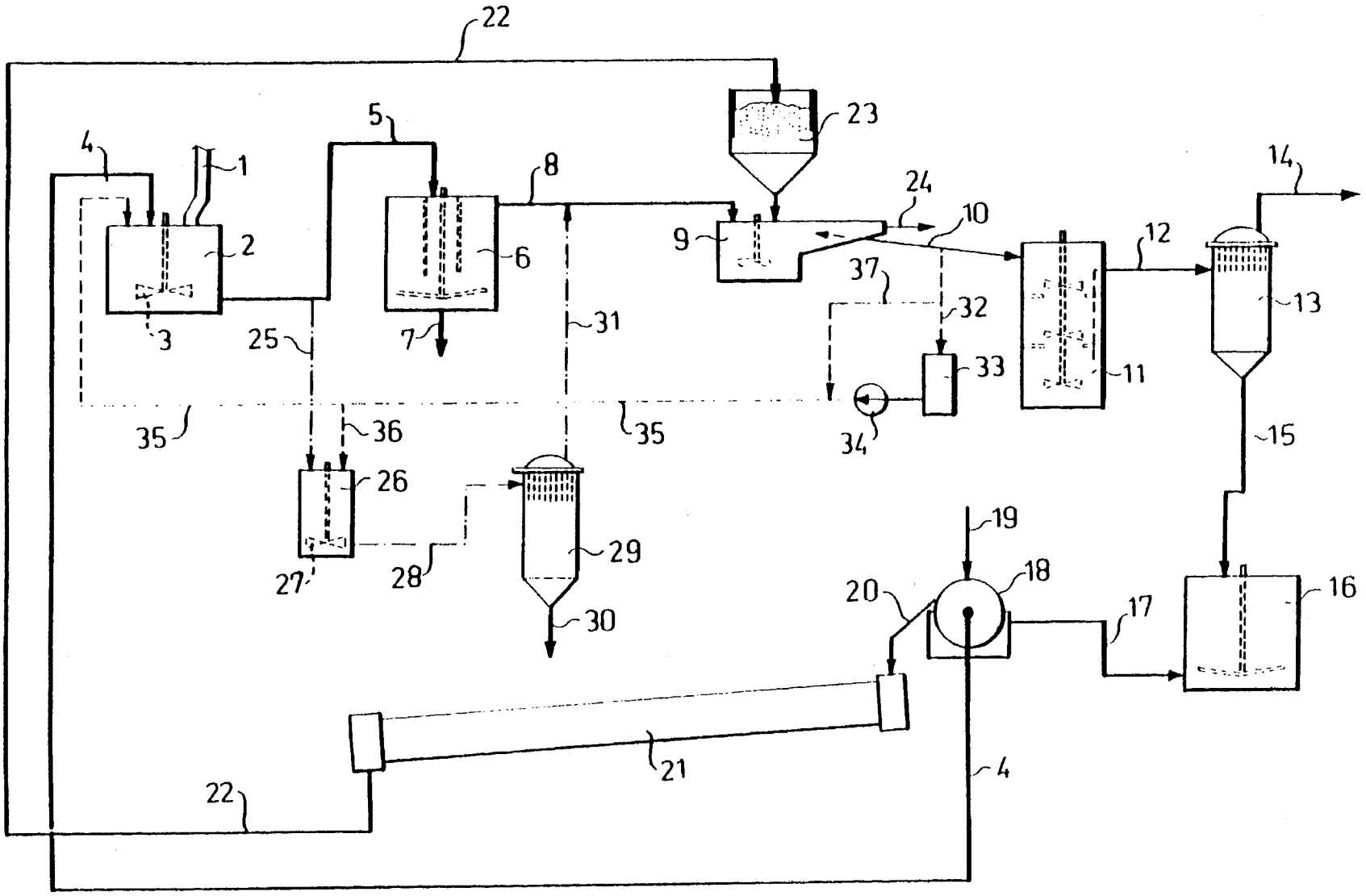
1
2
3
4
5
6
7
8
9
10
11
12
13
14
15
16
17
18
19
20
21
22
23
24
25
26
27
28
29
30
31
32
33
34
35
36
37

METHOD AND APPARATUS FOR CLARIFYING GREEN LIQUOR

BACKGROUND OF THE INVENTION

The present invention relates to a process and a device in a chemicals recovery plant in a sulphate pulp mill.

From SE-B-8700549-2 there is known a process for treating green liquor, more particularly in such a way that the green liquor's content of particularly inorganic impurities and soot obtains better sedimentation and filtration properties and, owing to that, can be separated from the green liquor and accordingly removed from the chemicals cycle in a simpler and more effective way than before. This is achieved by adding to the non-clarified green liquor, while stirring quick lime comprising from 0.5 to 10%, preferably from 1 to 3% of the amount of quick lime necessary for complete causticizing of the green liquor.

According to SE-B-8700549-2 the quick lime is added either to a soda dissolver, in which melt from a soda recovery unit is dissolved in weak liquor, and from this to a mixing tank or directly to the mixing tank. From the mixing tank the green liquor formed is passed to a filter, from which solid particles are removed for dumping whereas clarified green liquor is passed to a lame slaker. From the lime slaker the mixture of lime and green liquor is passed to a causticizing tank from which the mixture of liquor and lime sludge formed is passed to a filter. The filtrate formed therein, white liquor, is passed to the digester house whereas the material filtered off, the lime sludge, is passed to a lime sludge silo. From this the lime sludge is passed to a washing filter from which the weak liquor formed is added to the above-mentioned soda dissolver whereas the lime sludge is passed into a lime kiln where it is burnt to lime. The quick lime is passed to the lime slaker as well as, according to the above, to either the soda dissolver or the mixing tank.

SUMMARY OF THE INVENTION

The object of the present invention is to simplify and cheapen the known process and owing to that also make a simplified and considerable more cheap device possible. The invention is based upon the understanding that it is the slaked lime formed in the soda dissolver and in the mixing tank, respectively, that is active in the process in order to obtain the desired result. According to the present invention it is therefore suggested that the addition of lime is in the form of already slaked lime, that is the slaked lime that is already present in the process and that is formed in the lime slaker. Thus, from the flow of lime and green liquor to the causticizing tank there is taken a partial flow which is passed to the mixing tank or alternatively to the soda dissolver. This is done before the causticizing process has been completed, i.e. that uncausticized liquor (lime milk) is passed into the mixing tank.

By using in this way slaked lime that is already present in the plant, the expensive and long conveyors, which, in plants according to SE-B-87005492, are required to convey slaked lime to the soda dissolver and the mixing tank respectively, are avoided. Instead there is obtained a closed system for lime circulation from the lime slaker through a line, provided for this purpose, to the mixing tank, alternatively the soda dissolver, from the mixing tank to the green liquor filter and then back to the lime slaker.

On the apparatus side there is required for this only that there is provided, from the existing line between the lime dissolver and the causticizing tank, a branch line to the mixing tank and the soda dissolver, respectively, optionally together with a pump, a pump vessel and means for regulating the partial flow withdrawn.

BRIEF DESCRIPTION OF THE DRAWINGS

The invention is explained in more detail in the following with reference to the enclosed schematic drawing showing an example of a chemicals recovery plant in a sulphate pulp mill set up to carry out the process of the invention.

DETAILED DESCRIPTION OF THE PREFERRED EMBODIMENT

In the drawing 1 designates a running shute which passes, from a soda recovery unit not shown, melt to a soda dissolver 2 in which there is a stirrer 3. In the soda dissolver 2 also a line 4 for weak liquor concludes. From the soda dissolver 2 a line for green liquor passes to a green liquor clarifier 6, from the bottom of which sediment can be removed through a line 7. From the green liquor clarifier 6 a line 8 for clarified green liquor passes to a lime slaker 9, from which a line 10 for slaked lime and green liquor passes to a causticizing tank 11. A line 12 connects the causticizing tank 11 with a white liquor filter 13, from which on one hand a line 14 passes carrying filtered white liquor to a digester house not shown and, on the other hand, a line 15 carrying filtered-off material (lime sludge) to a lime sludge silo 16. From this a line 17 passes to a washing filter 18, in which the lime sludge is washed with hot water entering the washing filter through a line 19. In the washing filter the weak liquor formed is passed through the line 4 previously mentioned to the green liquor clarifier 6 whereas the lime sludge is passed, through a path 20, into a lime kiln 21 for burning to quick lime. The quick lime is passed through a line or conveyor 22 to a lime silo 23, from which quick lime is withdrawn to the lime slaker 9. For so-called draining of the lime cycle the lime slaker 9 is provided with a drainage 24 for inert substances. All lines mentioned above are shown in the drawing with solid lines.

As an alternative to passing, through line 5, the green liquor from the soda dissolver 2 to the green liquor clarifier 6, the green liquor may be passed, through a line 25, to a mixing tank 26 provided with a stirrer 27 and from this through a line 28 to a green liquor filter 29, from which filtered-off material (sludge)is passed for dumping through a line 30, whereas filtered green liquor is passed, through a line 31 connected to line 8, to the lime slaker 9. The alternative lines 25, 28 and 3i are shown with dash dotted lines.

The plant described above is a conventional one. According to the prior art of SE-B-8700549-2 the conventional plant has been supplemented in that alternative lines or conveyors pass from the line or conveyor 4 in order to introduce quick lime into to the soda dissolver 2, alternatively the mixing tank 26.

In order to save the considerable plane and operation costs for these lines or conveyors, it is suggested according to the present invention, as mentioned above, that slaked lime (lime milk) is taken from the flow in line 10 from the line slaker 9 to the causticizing tank 11. For this purpose there is provided in line 10 a branch line 32, which passes, through an optional pump jar 33 with the subsequent pump 34 and a line 35, the lime milk to the soda dissolver 2—in case a green liquor clarifier 6 is used—or through a line 36 to the mixing tank 26—in case such a one is used. In case any pump is not required to transport the lime milk, the line 32 may be connected directly to line 35 through a line 37.

Means, which are not shown, for regulating the partial flow withdrawn from line 10, e.g. 3% of the total flow, are of course provided in lines 32 and 37 (comprising control means for the pump 34) and in line 37, respectively, such as valves and other metering means making sure that the addition of slaked lime to the soda dissolver and the mixing tank, respectively, will be as intended.

Through the invention there has been provided an "inner" cycle in the form of a completely closed system which differs from the conventional "outer" lime cycle as well as from the lime cycle known from SE-B-8700549-2 with drainage to the soda dissolver or the mixing tank and which as such does not require any replenishment of lime because of drainage, since the necessary amount of lime in the form of slaked lime is continuously taken from the outer lime cycle through line 32.

We claim:

1. A process for producing green liquor with improved sedimentation and filtration properties in a chemicals recovery plan of a sulphate pulp mill comprising:

introducing weak liquor and melt into a soda dissolver in order to form unclarified green liquor;

directing a flow of unclarified green liquor from the soda dissolver to a clarifier to remove solid particles from the unclarified green liquor so as to produce clarified green liquor;

directing a flow of clarified green liquor from the clarifier to a lime slaker;

introducing a supply of lime into the lime slaker along with the clarified green liquor from the clarifier;

directing a flow of slaked lime from the lime slaker to a causticizing tank; and re-directing a partial portion of the flow of slaked lime, prior to the causticizing tank, to one of the soda dissolver and a mixing tank interposed in the flow path of green liquor from the soda dissolver to the lime slaker to improve the removal of solid particles from the unclarified green liquor, wherein the partial portion of the flow of slaked lime corresponds to approximately 3% of the total flow from the lime slaker to the causticizing tank.

2. A chemical recovery system in a sulphate pulp mill for producing green liquor with improved sedimentation and filtration properties comprising:

a soda dissolver into which weak liquor and melt are introduced and processed so as to form green liquor;

a green liquor clarifier;

a lime slaker;

a first flow line in flow communication from said soda dissolver through said green liquor clarifier to said lime slaker;

means for introducing lime into said lime slaker;

a causticizing tank;

a second flow line in flow communication from said lime slaker to said causticizing tank; and a branch line means for re-directing a partial portion of the flow of slaked lime, prior to said causticizing tank, to said soda dissolver.

3. The system according to claim 2, wherein said branch line means comprises a pump.

4. The system according to claim 3, wherein said branch line means comprises a pump jar.

5. A chemical recovery system in a sulphate pulp mill for producing green liquor with improved sedimentation and filtration properties comprising:

a soda dissolver into which weak liquor and melt are introduced and processed so as to form green liquor;

a green liquor filter;

a lime slaker;

a first flow line in flow communication from said soda dissolver through said green liquor filter to said lime slaker;

a mixing tank provided in said first flow line between said soda dissolver and said green liquor filter;

means for introducing lime into said lime slaker;

a causticizing tank;

second flow line in flow communication from said lime slaker to said causticizing tank; and a branch line means for re-directing a partial portion of the flow of slaked lime, prior to said causticizing tank, to said mixing tank.

6. The system according to claim 5, wherein said branch line means comprises a pump.

7. The system according to claim 6, wherein said branch line means comprises a pump jar.

* * * * *